US010350609B2

(12) United States Patent
Rhodes, Jr.

(10) Patent No.: US 10,350,609 B2
(45) Date of Patent: Jul. 16, 2019

(54) ASSEMBLY AND METHOD FOR GRAVITATIONALLY SEPARATING GOLD FROM SMALL PARTICLES

(71) Applicant: Jesse W. Rhodes, Jr., Moncks Corner, SC (US)

(72) Inventor: Jesse W. Rhodes, Jr., Moncks Corner, SC (US)

( * ) Notice: Subject to any disclaimer, the term of this patent is extended or adjusted under 35 U.S.C. 154(b) by 0 days.

(21) Appl. No.: 15/800,858

(22) Filed: Nov. 1, 2017

(65) Prior Publication Data

US 2018/0071748 A1 Mar. 15, 2018

Related U.S. Application Data

(62) Division of application No. 15/190,825, filed on Jun. 23, 2016, now Pat. No. 9,833,790.

(60) Provisional application No. 62/190,573, filed on Jul. 9, 2015.

(51) Int. Cl.

| | |
|---|---|
| ***B03B 5/00*** | (2006.01) |
| ***C22C 5/02*** | (2006.01) |
| ***B07B 1/04*** | (2006.01) |
| ***B07B 1/06*** | (2006.01) |
| ***B07B 13/16*** | (2006.01) |

(52) U.S. Cl.

CPC ..... *B03B 5/00* (2013.01); *B07B 1/04* (2013.01); *B07B 1/06* (2013.01); *B07B 13/16* (2013.01); *C22C 5/02* (2013.01); *B07B 2230/01* (2013.01)

(58) Field of Classification Search

CPC .. B03B 5/00; B03B 5/62; B03B 5/623; B03B 5/66; B07B 1/04; B07B 13/16; B07B 2201/04; B07B 2230/01

See application file for complete search history.

(56) References Cited

U.S. PATENT DOCUMENTS 933,772 A 9/1909 Luttrell
1,483,371 A * 2/1924 Miller ..... B03B 5/623 209/159

(Continued)

OTHER PUBLICATIONS

Derwent Abstract 1997-204408 of DE 19536 303; Inventor: Braeuer; Sep. 1995.*

*Primary Examiner* — Jospeh C Rodriguez

(74) *Attorney, Agent, or Firm* — Vincent G. LoTempio; Kloss, Stenger & LoTempio; David T. Stephenson

(57) ABSTRACT

An assembly and method for gravitationally separating gold from particles, and specifically for separating small components of gold, less than 1 millimeter from small particles. A series of sieves having graduated mesh sizes, and arranged in a sequential, stacked configuration sieves the aggregate of large particles and larger components of gold. The remaining small particles and smaller components of gold fall into a container. A pressurized column of fluid is forced into the container. The fluid has sufficient flow velocity to suspend the lighter small particles, but insufficient flow velocity to support the denser, high specific gravity gold. Gold has a large specific gravity relative to the fluid and particles. Gravity causes the gold to falls into a transparent collection conduit. Manipulation of valves enables gold to redirect to a collection bin. Fluid flow is shut, enabling small particles to be flushed out through gravitational forces and excess fluid momentum.

20 Claims, 11 Drawing Sheets

(56) References Cited

U.S. PATENT DOCUMENTS

| | | | | | |
|---|---|---|---|---|---|
| 2,325,881 | A * | 8/1943 | Robertson | B03B 5/68 | 209/154 |
| 4,101,419 | A * | 7/1978 | Bergman | B03B 5/62 | 209/13 |
| 4,388,182 | A * | 6/1983 | Hudson | B03B 5/66 | 209/158 |
| 4,557,759 | A | 12/1985 | McGrew et al. | | |
| 4,715,949 | A * | 12/1987 | Watts | B03B 7/00 | 209/157 |
| 4,784,757 | A * | 11/1988 | Nelson | B03B 5/623 | 209/159 |
| 602,113 | A | 6/1995 | Zaffiro | | |
| 5,896,997 | A * | 4/1999 | Tanner | B03B 5/26 | 209/268 |
| 5,944,196 | A * | 8/1999 | Oram | B03B 5/623 | 209/158 |
| 6,425,485 | B1 * | 7/2002 | Mankosa | B03B 5/623 | 209/158 |
| RE38,367 | E * | 12/2003 | Southall | B03B 9/00 | 175/206 |
| 8,113,355 | B1 * | 2/2012 | Peterson | B03B 5/02 | 209/235 |
| 9,833,790 | B2 * | 12/2017 | Rhodes, Jr. | B03B 5/00 | |
| 9,968,948 | B1 * | 5/2018 | Olivier | B03B 7/00 | |
| 2017/0043352 | A1 * | 2/2017 | Ross | B03B 5/623 | |

* cited by examiner

ASSEMBLY AND METHOD FOR GRAVITATIONALLY SEPARATING GOLD FROM SMALL PARTICLES

CROSS REFERENCE OF RELATED APPLICATIONS

This application is a divisional application and claims the benefits of U.S. non provisional application Ser. No. 15/190,825, filed Jun. 23, 2016 and entitled Assembly and Method For Gravitationally Separating Gold From Small Particles, which non provisional application is incorporated by reference herein in its entirety. No new matter has been introduced.

FIELD OF THE INVENTION

The present invention relates generally to an assembly and method for gravitationally separating gold from small particles. More so, an assembly and method for gravitationally separating gold from small particles separates gold from small particles by initially sieving an aggregate of particles and gold through a series of sieves having graduated mesh sizes to remove the large particles and larger components of gold, and then applying gravitational separation by fluidizing the remaining mixture of small particles and gold with a pressurized column of fluid having sufficient flow velocity to suspended the lighter small particles, but insufficient flow velocity to support the more dense gold, which falls through a collection conduit; whereby the separated gold is redirected to a collection bin through manipulation of valves; whereby the small particles are subsequently discharged through a tailings drain through gravitational forces and momentum from excess fluids.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

It is known that gold extraction or recovery from its ores may require a combination of comminution, mineral processing, hydrometallurgical, and pyrometallurgical processes to be performed on the ore. Often, the gold is part of an aggregate containing sand, gravel, small rocks, and various minerals, such as quartz. In this aggregate, there are usually large nuggets of gold and smaller particles of gold, such as gold flakes. These smaller gold particles, i.e. one millimeter or less can be difficult to separate from other small particles, such as sand and gravel.

Generally, the aggregates that contain gold nuggets and flakes include sand, and specifically heavy sand. The heavy sand may contain gold flakes and other small gold particles so that more refined separation is necessary. Conventionally, the separation of the heavy sand away from the gold is by panning. In such panning, great care is used if little gold is wasted.

Gold panning is a simple process that relies on agitation of the sand, gravel, and gold to induce separation. Once a suitable placer deposit is located, some gravel from it is scooped into a pan, where it is then gently agitated in water and the gold sinks to the bottom of the pan. Materials with a low specific gravity are allowed to spill out of the pan, whereas materials with a high specific gravity sink to the bottom of the sediment during agitation and remain within the pan for examination and collection by the gold panner. Such careful panning is necessarily time-consuming so that the final separation from the portion conserved by the separator is tedious.

Typically, gold mining sites are located in relatively remote areas, or the amount of ore at a given site may be relatively small. In such cases the expense involved in permanent, on-site construction of refining equipment may be greater than the expected return from mining. Thus, there is a real need for an effective, portable unit for gold or other ore refining.

Other proposals have involved separating gold from ore and other particles. The problem with these gold separation devices and methods is that they do not effectively separate smaller particles from smaller gold nuggets and flakes. Even though the above cited gold separation devices and methods meets some of the needs of the market, an assembly and method for gravitationally separating gold from small particles that involves initially sieving for large particle separation, and then applying gravitational separation for separating small particles from the gold, is still desired.

SUMMARY OF THE INVENTION

The present invention is directed to an assembly and method for gravitationally separating gold from small particles. The assembly and method for separating gold from small particles is configured to separate gold from particles; and specifically smaller components of gold from finer, small particles. The assembly and method provides a series of sieves having graduated mesh sizes. The sieves are arranged in a sequential, stacked configuration. The sieves are in general alignment with an open end of a container having a sloped sidewall.

The sieves are configured to sieve an aggregate of particles and gold, removing the larger components thereof. The sieves are arranged to graduate from a sieve having a large mesh size, to a sieve having a small mesh size, such that an aggregate of large particles, and large components of gold are initially separated from the remaining small particles and smaller components of gold, which fall through the smallest sieve, and into the open end of the container.

After sieving the aggregate of larger particles and gold, gravitational separation is used to separate the remaining gold from the small particles, i.e., less than 1 millimeter diameter. In one embodiment, a pressurized column of fluid is forced upwardly, towards the aggregate of small particles and remaining gold that passed through the sieves. The flow velocity may be increased until the aggregate is fluidized and separation of gold from particles begins. The fluid has sufficient flow velocity to suspend the lighter small particles, but insufficient flow velocity to support the more dense gold.

Consequently, the gold falls through the pressurized column of fluid through forces of gravity and the specific gravity of the gold relative to the fluid and small particles. Thus, the gold falls to a bottom end of the container, through the aperture, and into a collection conduit having a container end and a source end.

The flow velocity of the fluid from the fluid source towards the container is controllable through a flow regulation valve. In this manner, the pressure and volume of the fluid may be regulated until substantially only gold falls through the aperture and into the collection conduit. The collection conduit may be disposed vertically near the aperture, so as to optimize gravitational forces that carry the gold through the collection conduit. However, the vertical slope of the collection conduit progressively flattens to a horizontal disposition for retention of the separated gold in this horizontal section of the collection conduit. When the gold ceases to fall through the aperture and collect in the horizontal section of the collection conduit, this indicates that the gold is substantially separated from the small particles.

At this point of the separation process, a container valve at the container end of the collection conduit is closed to restrict flow of the fluid into the container and prevent the small particles from falling into the collection conduit. An extraction conduit is in communication with the container end of the collection conduit. The extraction conduit is configured to carry the gold from the collection conduit to a collection bin. An extraction valve along the extraction conduit may be opened to enable the fluid to carry the separated gold through the extraction conduit.

After the gold is collected in the collection bin, the extraction valve is closed to shut off communication with the gold in the collection bin. The flow regulation valve is closed to shut off the flow of fluid towards the container. The container valve is opened to enable discharge of the small particles from the container through the aperture, and into the collection conduit.

A dump valve regulates the flow of the fluid from the collection conduit into a tailings drain. The dump valve may be opened so that the remaining small particles can be carried through the tailings drain. The tailings drain is in communication with the source end of the collection conduit to enable discharge of the remaining small particles. It is significant to note that the force of gravity and momentum from excess fluid that has accumulated in the container carry the small particles from the container to the tailings drain through the collection conduit.

In one embodiment, a backflow prevention valve may be operatively connected to the fluid supply to restrict undesirable backflow in the collection conduit, which may block the free backflow of small particles and cause contamination of the fluid. The backflow prevention valve is also useful for preventing the loss of any gold if fluid supply pressure is lost. In another embodiment, the container may include a trough for retaining excess fluid that accumulates. A container conduit leading from the trough may join with a fluid drain that discharges the excess fluid.

In one aspect, an assembly for separating gold from small particles, comprises: a container, the container defined by an open end, a sidewall, and a bottom end, the bottom end comprising an aperture;

a series of sieves having graduated mesh sizes, the series of sieves arranged in a sequential, stacked configuration in general alignment with the open end of the container, whereby a sieve having a small mesh is proximal to the open end of the container and a sieve having a large mesh is distal to the open end of the container;

a collection conduit, the collection conduit defined by a source end and a container end, the container end configured to join with the aperture of the container;

a fluid source, the fluid source configured to enable the flow of a fluid through the collection conduit;

a flow regulation valve, the flow regulation valve operational at the fluid source, the flow regulation valve configured to regulate the flow rate of the fluid;

a container valve, the container valve operational at the container end of the collection conduit, the container valve configured to regulate the flow of the fluid to the container;

an extraction conduit, the extraction conduit defined by a first end and a second end, the first end in communication with the container end of the collection conduit;

a collection bin, the collection bin configured to join with the second end of the extraction conduit;

an extraction valve, the extraction valve configured to regulate the flow of the fluid through the extraction conduit;

a tailings drain, the tailings drain in communication with the source end of the collection conduit; and a dump valve, the dump valve configured to regulate the flow of the fluid through the tailings drain.

In another aspect, the sidewall of the container is generally sloped.

In another aspect, the sidewall tapers from the open end to the bottom end.

In another aspect, the container is a hopper.

In another aspect, the series of sieves includes at least one member selected from the group consisting of: a ½ inch mesh, a ¼ inch mesh, a ⅛ inch mesh, a 1/16 inch mesh, a 1/32 inch mesh, and a 1/64 inch mesh.

In yet another aspect, the fluid is water.

In yet another aspect, the collection conduit is generally transparent.

In yet another aspect, the collection conduit is disposed in a vertical orientation for about 0.5 meters from the aperture.

In yet another aspect, the fluid source comprises an inline pump.

In yet another aspect, the fluid source comprises a pressure regulator.

In yet another aspect, the pressure regulator is configured to help stabilize the flow of fluid when the fluid source is not stable.

In yet another aspect, the source end of the collection conduit comprises a gate valve configured to regulate the volume of the fluid.

In yet another aspect, wherein the tailings drain is configured to be shut off.

In yet another aspect, the container comprises a trough, the trough configured to retain excess fluid.

In yet another aspect, the container comprises a container conduit, the container conduit configured to carry the excess fluid from the trough.

In yet another aspect, the container comprises a fluid drain, the fluid drain configured to discharge the excess fluid.

In yet another aspect, the assembly comprises a backflow prevention valve, the backflow prevention valve configured to operatively attach to the tailings drain, the backflow prevention valve further configured to help inhibit backflow of the fluid, which may block the free backflow of small particles and cause contamination of the fluid. The backflow prevention valve is also useful for preventing the loss of any gold if fluid supply pressure is lost.

In one aspect, a method for separating gold from small particles, comprises:

sieving an aggregate of particles and gold, whereby large particles and large components of the gold are separated from small particles and small components of the gold;

removing the large particles and large components of gold;

forcing a pressurized column of fluid towards the remaining small particles and the remaining gold;

adjusting a flow velocity of the fluid until the small particles and the gold are substantially separated, whereby the small particles are suspended by the flow velocity of the fluid, whereby the gold falls against the flow velocity of the fluid through forces of gravity and the specific gravity of the gold;

redirecting the path of the gold for collection;

restricting flow of the pressurized column of fluid; and discharging the small particles through forces of gravity and momentum from excess fluid.

In another aspect, the step of sieving an aggregate of particles and gold, further comprises washing the aggregate of particles and gold.

In another aspect, the step of sieving an aggregate of particles and gold is operable with a series of sieves having graduated mesh sizes.

In another aspect, the series of sieves includes at least one member selected from the group consisting of: a ½ inch mesh, a ¼ inch mesh, a ⅛ inch mesh, a 1/16 inch mesh, a 1/32 inch mesh, and a 1/64 inch mesh.

In another aspect, the remaining gold after removal of the large particles and large components of gold is smaller than about 1 millimeter.

In another aspect, the step of forcing a pressurized column of fluid towards the remaining small particles and the remaining gold, further comprises opening a flow regulation valve.

In another aspect, the step of adjusting a flow velocity of the fluid until the small particles and the gold are substantially separated, further comprises retaining the gold in a collection conduit.

In another aspect, the step of redirecting the path of the gold for collection, further comprises closing a container valve and opening an extraction valve.

In another aspect, the step of redirecting the path of the gold for collection, further comprises collecting the gold in a collection bin.

In another aspect, the step of restricting flow of the pressurized column of fluid, further comprises closing the flow regulation valve.

It is one objective of the present invention to provide an assembly and method for separating gold from small particles that separates aggregate particles and large components of gold from gold that is less than 1 millimeter.

It is another objective to provide a series of sieves that separate the larger aggregates and components of gold, from the smaller aggregates and smaller components of gold.

It is another objective to provide a gold separator which quickly, easily and accurately separates gold from heavy materials and small particles through fluidization and gradient weight separation.

Yet another objective is to systematically regulate the flow of fluid through the conduits in the assembly by opening and closing various valves.

Yet another objective is to easily discharge the small particles after the gold has been collected.

Yet another objective is to provide a gold separator that minimizes the use of moving parts.

Yet another objective is to provide a gold separator which is economic of construction and simple of operation.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which:

FIG. 1A is a perspective view, FIG. 1B is a blowup view of fully separated gold in a horizontal section of the collection conduit, and FIG. 1C is a blowup view of gold and small particles beginning separation in a vertical section of a collection conduit, in accordance with an embodiment of the present invention;

Like reference numerals refer to like parts throughout the various views of the drawings.

DETAILED DESCRIPTION OF THE INVENTION

Figure 1A:
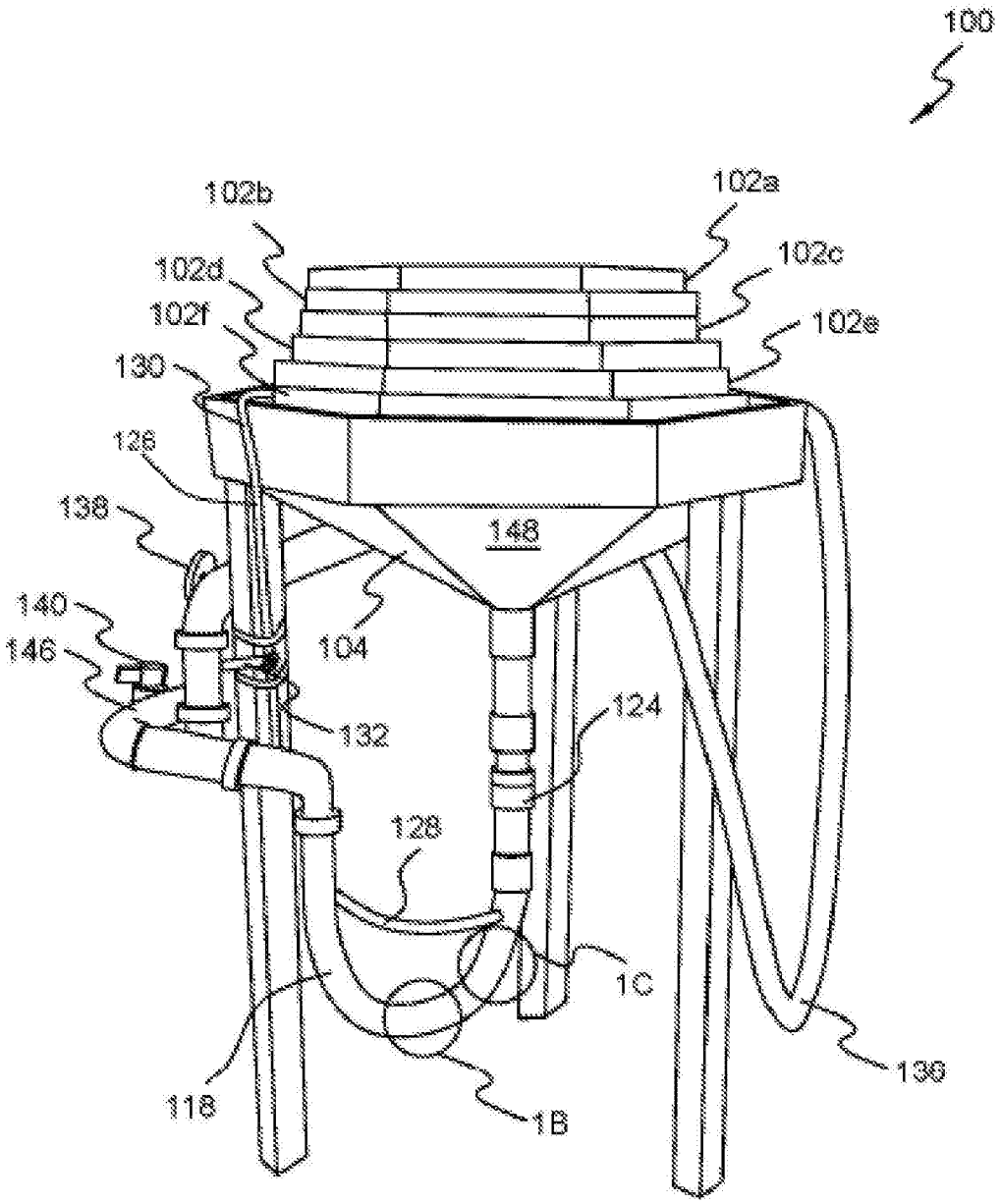
FIGS. 1A, 1B, and 1C illustrates views of an exemplary assembly for gravitationally separating gold from small particles, where

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1A. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

FIGS. 1-10 illustrate an assembly 100 and method 200 for gravitationally separating gold 300 from particles, and specifically for separating small components of gold 300 from small particles 302. In some embodiments, assembly 100 operates in two stages. A first stage sieves an aggregate 304 of particles and gold 300 to remove larger components, i.e., greater than 1 millimeter. The second stage utilizes gravitational separation to separate the smaller components of gold 300 from the small particles 302. This is accomplished by leveraging the physical characteristic of gold 300—namely having a large specific gravity relative to small particles 302 and a fluid used for separation.

In one embodiment of the second stage a pressurized column of fluid flows against the aggregate of gold 300 and the small particles 302. The fluid has sufficient flow velocity to suspend the lighter small particles 302, but insufficient flow velocity to support the more dense gold 300. Thus, the gold 300 separates through forces of gravity and its own specific gravity, relative to the fluid and the small particles 302.

Figure 1B:
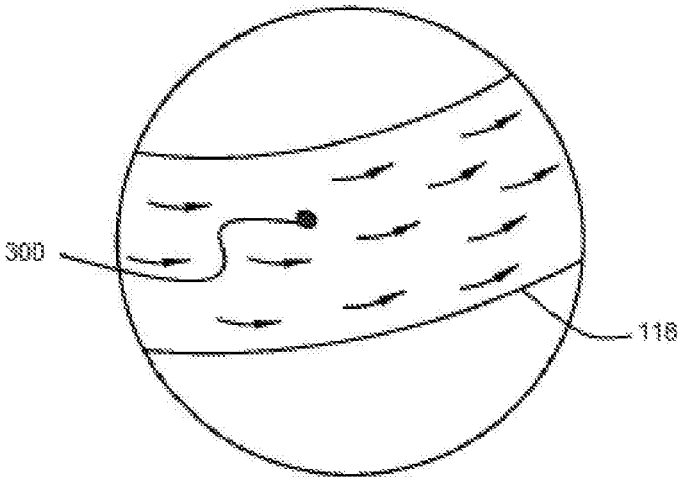
Figure 1C:
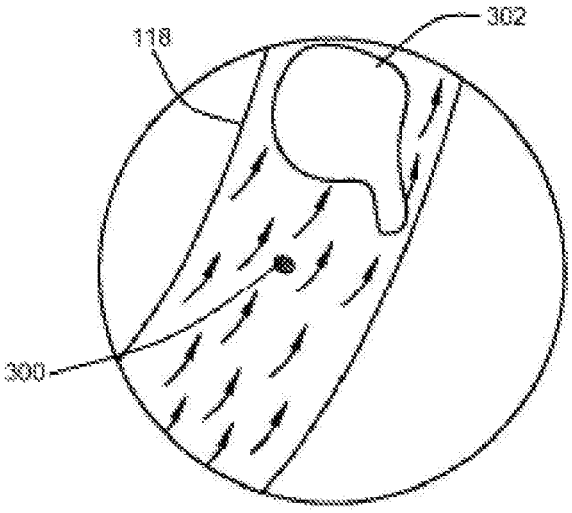
Figure 2:
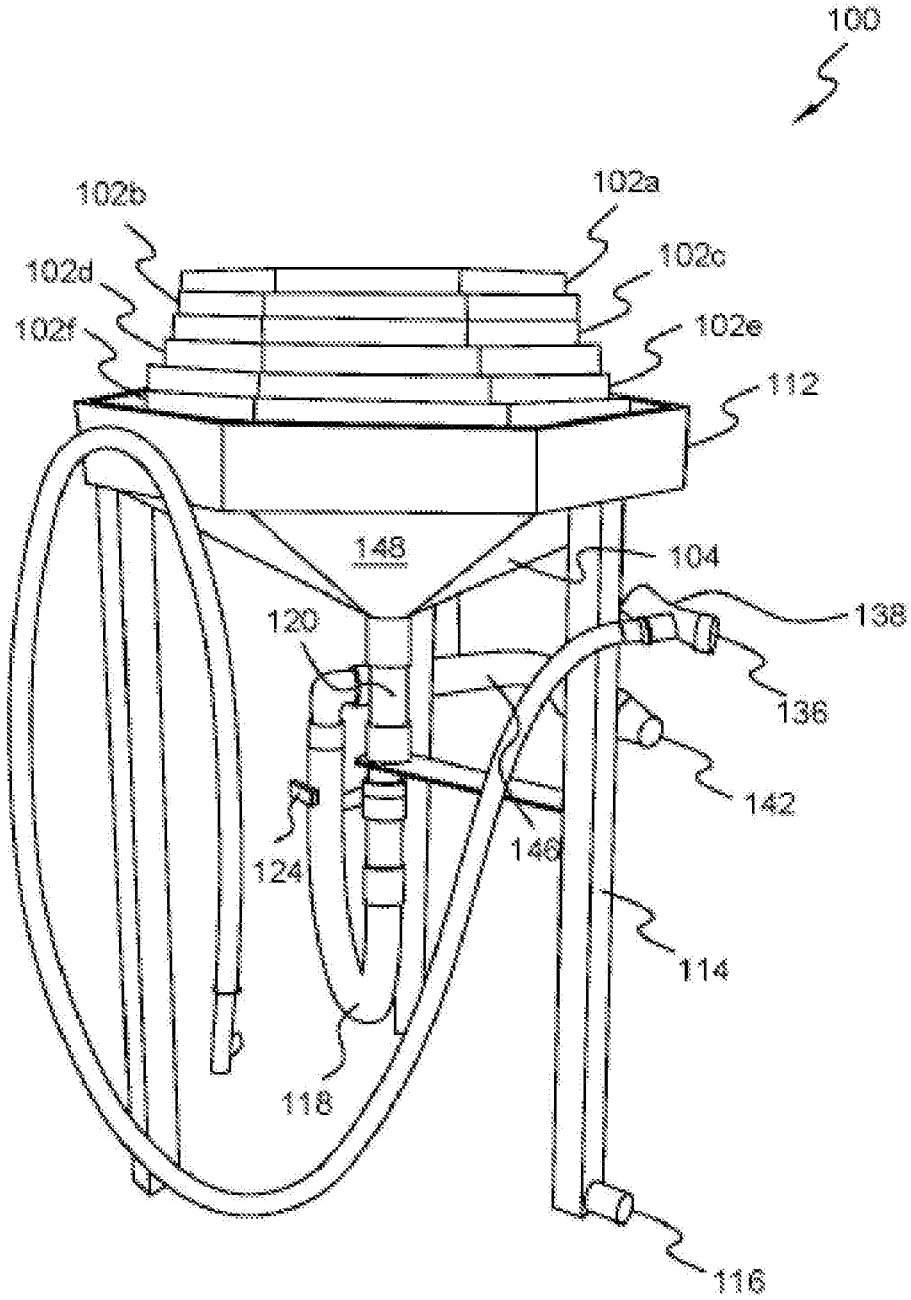
FIG. 2 illustrates a rear perspective of the assembly for gravitationally separating gold from small particles shown in FIG. 1A, in accordance with an embodiment of the present invention.

As FIGS. 1A, 1B, and 1C illustrate, assembly 100 provides a container 104 defined by an open end 106, a sidewall 148, and a bottom end 108. The container 104 provides the volume for receiving the aggregate 304 after sieving. The container 104 serves primarily as a reservoir for retaining the small particles 302, gold 300, and excess fluid that pass through the sieves 102*a-f*—until the gold 300 falls through an aperture 110 in the bottom end 108 of the container 104 during separation. The sidewall 148 of the container 104 may be sloped and taper from the open end 106 to the bottom end 108. In one embodiment, the container 104 is a hopper with supportive legs. Thus, the container 104 is also portable.

As discussed above, bottom end 108 of the container 104 comprises an aperture 110 through which fluid, gold 300, and small particles 302 pass through in various stages of the separation process. A container valve 124 proximal to aperture 110 of container 104 operates to regulate the flow of the fluid into container 104, so as to enable greater control of the separation process.

In some embodiments, container 104 comprises a trough 112 that is configured to retain excess fluid. Trough 112 may encircle the periphery of container 104. Container 104 may also include a container conduit 114 configured to carry the excess fluid from trough 112. Container conduit 114 terminates at a fluid drain 116. In one embodiment, shown in FIG. 2, fluid drain 116 forms at one of the legs of container 104.

Figure 3:
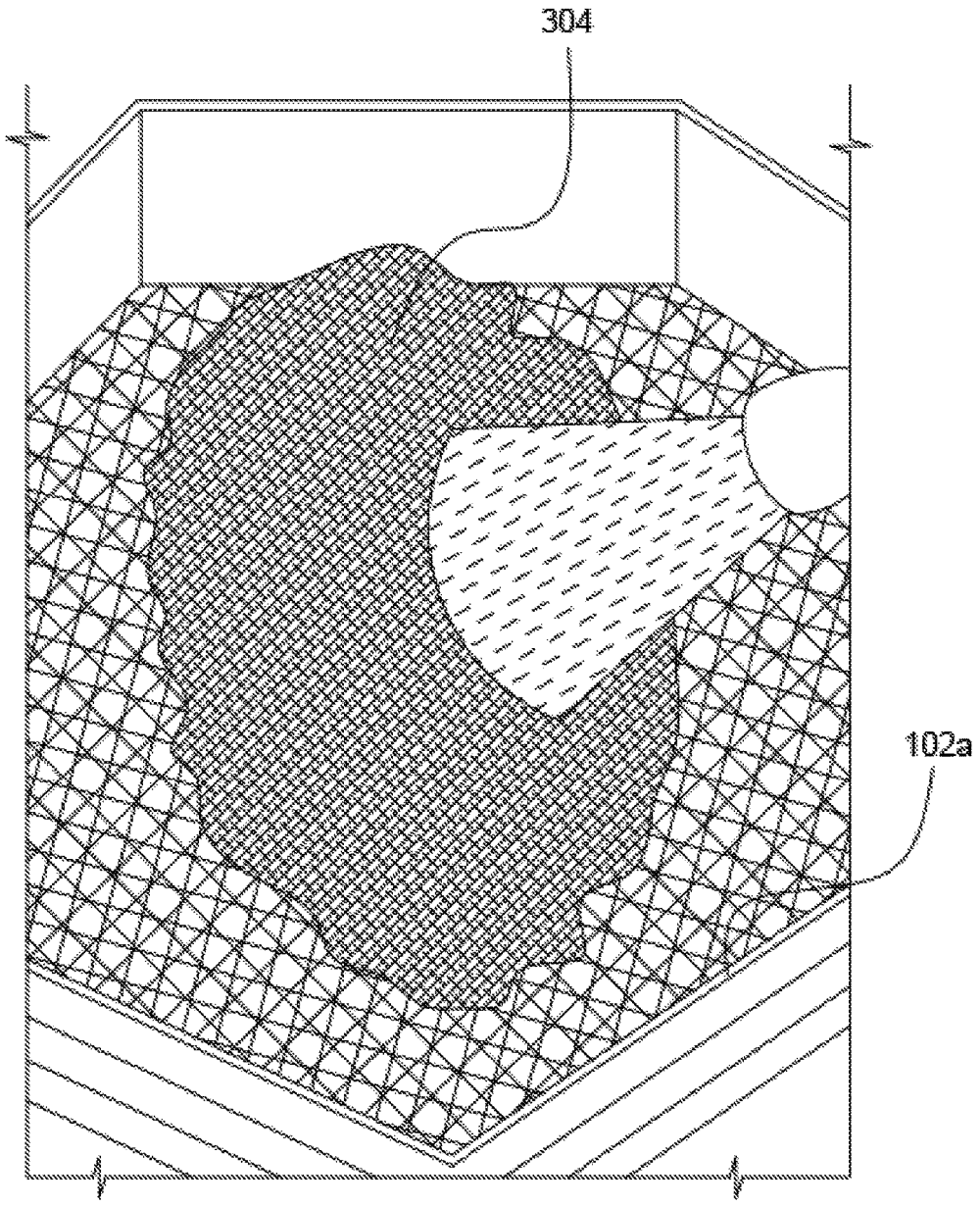
FIG. 3 illustrates an upper angle perspective of an exemplary aggregate being washed through a plurality of sieves, in accordance with an embodiment of the present invention.

Turning now to FIG. 3, assembly 100 further includes a series of sieves 102*a-f* having graduated mesh sizes for sieving an aggregate 304 of particles and gold 300. Series of sieves 102*a-f* are arranged in a sequential, stacked configuration. Sieves 102*a-f* are in general alignment with open end 106 of a container 104. Sieves 102*a-f* are configured to sieve an aggregate of particles and gold 300.

Sieves 102*a-f* are arranged to graduate from a sieve 102*a* having a large mesh size, to a sieve 102*f* having a small mesh size, such that aggregate 304 of large particles and large components of gold are initially separated from the remaining small particles 302 and smaller components of gold 300, which gravity causes to fall through the smallest sieve 102*f*, and through open end 106 of the container 104.

Those skilled in the art will recognize that the large, denser aggregate particles 304 trapped in the series of sieves 102*a-f* may consist primarily of a black, magnetite sand, gravel, rocks, gemstones, and minerals. The small particles 302 may include sand sediment and small pebbles, and metal dust often found in the deposit and used for source material. The larger components of gold 300, as described here, are approximately greater than 1 millimeter in diameter. The smaller components of gold that fall through the sieves 102*a-f* with the small particles 302 are approximately less than 1 millimeter. Though, these dimensions are relative, and could be increased or decreased depending on particle composition and the type of ore being physically broken and separated.

In one embodiment, a sieve 102*f* having a small mesh is proximal to open end 106 of container 104, and a sieve 102*a* having a large mesh is distal to open end 106 of container 104. In some embodiments, the aggregate 304 of particles and gold 300 may be washed while passing through the sieves 102*a-f*. Thus both the force of washing and gravity work together to separate the large particles and large components of gold through sieves 102*a-f*. Though in other embodiments, the separating capacity of sieves 102*a-f* may be adjusted to any size particles. The assembly is generally scalable.

Figure 4:
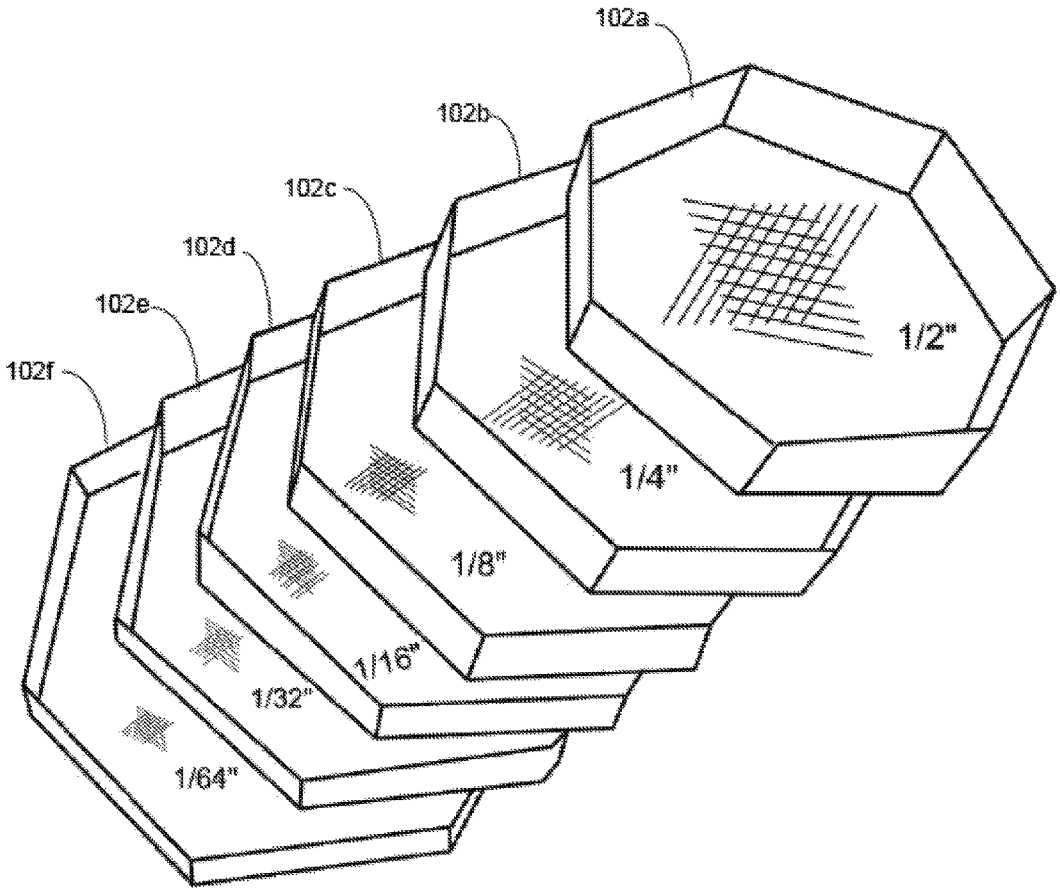
FIG. 4 illustrates a perspective view of the sieves in a graduated relationship, in accordance with an embodiment of the present invention.

As FIG. 4 illustrates, the series of sieves 102*a-f* includes at least one member selected from the group consisting of: a sieve 102*a* having a ½ inch mesh; a sieve 102*b* having a ¼ inch mesh; a sieve 102*c* having a ⅛ inch mesh; a sieve 102*d* having a 1/16 inch mesh; a sieve 102*e* having a 1/32 inch mesh; and a sieve 102*f* having a 1/64 inch mesh (FIG. 4). In this manner, the various component sizes of gold 300 may be selectively separated and collected. However in other embodiments, more or less sieves could be used. In one alternative embodiment, more advanced sieving devices may be utilize, which have rectangular shaker boxes with slots instead of screens and use air flow instead of a liquid, such as water.

It is significant to note however, that the smallest components of gold 300 may pass through the smallest of the mesh—namely gold 300 having dimensions of 1 millimeter or less, such as flakes of gold 300. Thus, the assembly 100 utilizes a second stage of separation to separate these smaller components of gold 300 from small particles 302 that were also less than 1 millimeter and thus, passed through the sieve 102*f* having the smallest mesh.

Looking back at FIG. 1A, assembly 100 comprises a collection conduit 118. Collection conduit 118 is defined by a source end 122 and a container end 120. Container end 120 is configured to detachably attach to aperture 110 of container 104. In one embodiment, collection conduit 118 is generally transparent. A fluid source 136 feeds the collection conduit 118 a fluid. The fluid may include water. Fluid source 136 provides the fluid that flows through collection conduit 118 and other conduits, described below. In one embodiment, an inline pump may be used to force the fluid from fluid source 136. Fluid may include, without limitation, fresh water, salt water, and a liquid having low specific gravity relative to gold 300

Looking back at FIG. 1A, a flow regulation valve 138 is operational at the fluid source 136. Flow regulation valve 138 is configured to regulate the flow rate of the fluid through collection conduit 118, through aperture 110, and into container 104. Flow regulation valve 138 is configured to regulates, direct, or control the flow of a fluid (gases, liquids, fluidized solids, or slurries) by opening, closing, or partially obstructing the conduits in the assembly 100. Suitable valves for flow regulation valve 138 may include, without limitation, a butterfly valve, a gate valve, a ball valve, a hydraulic valve, and a motorized valve.

Figure 5:
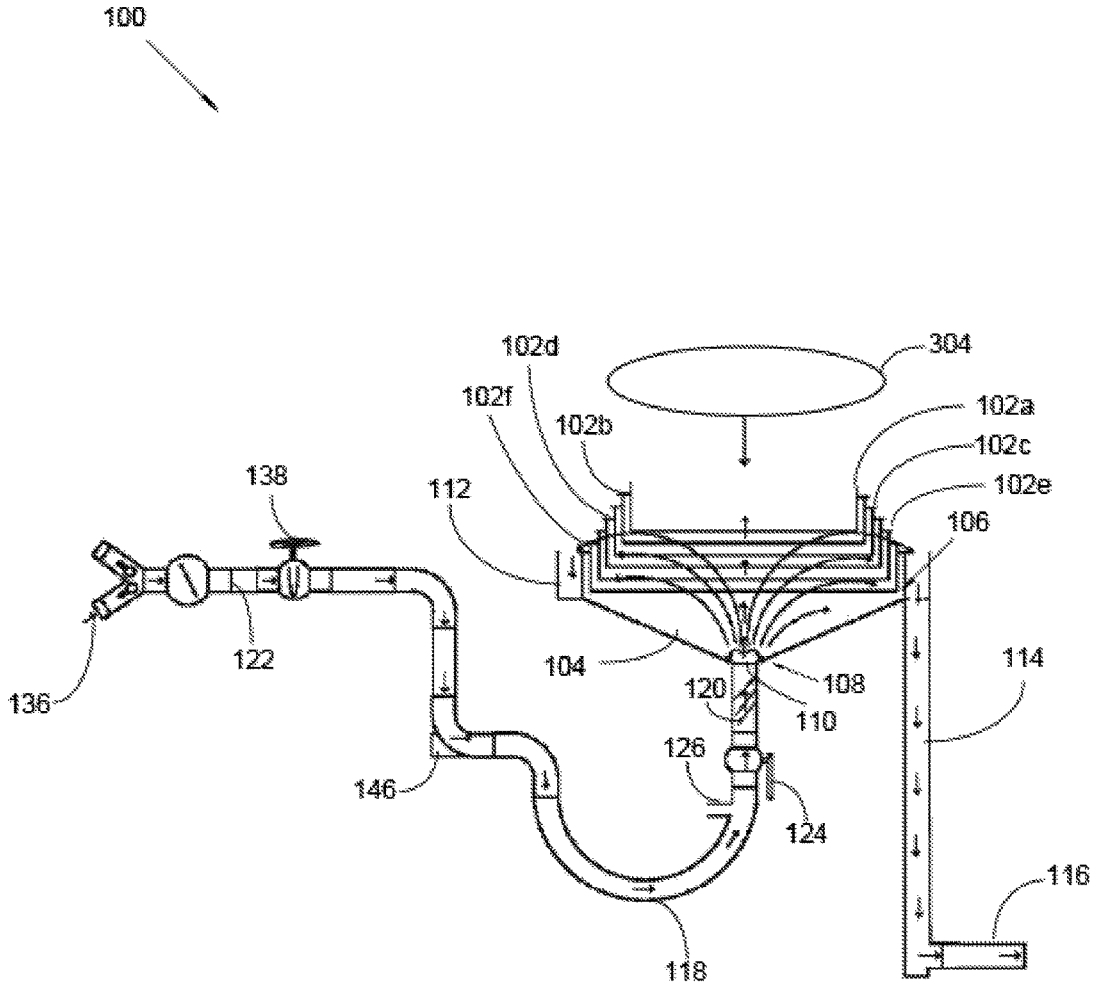
FIG. 5 illustrates a diagram of the assembly shown in FIG. 1A, where the aggregate passes through the sieves, in accordance with an embodiment of the present invention.
Figure 6:
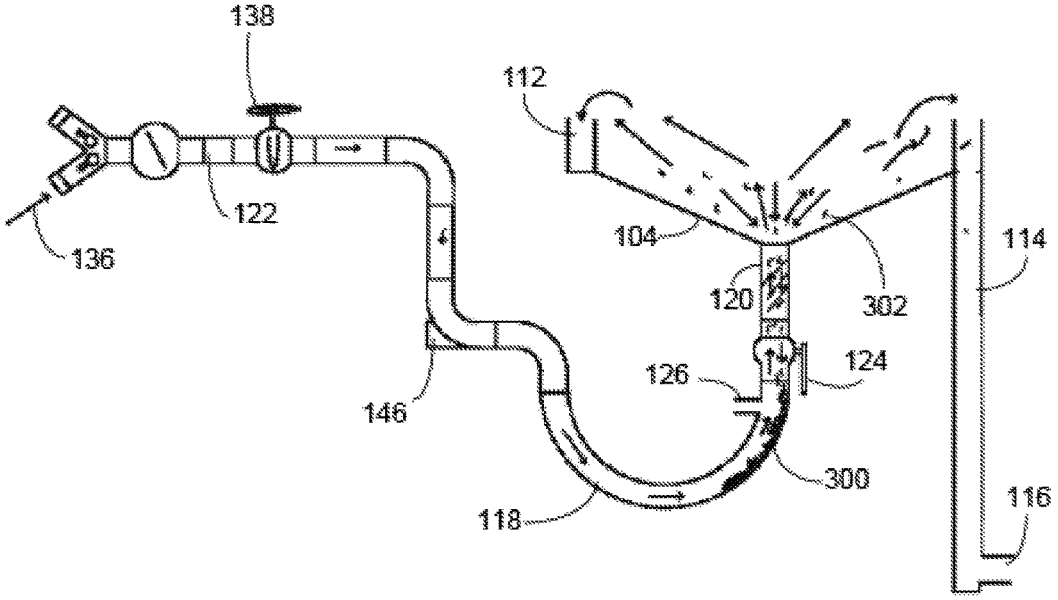
FIG. 6 illustrates a diagram of the assembly shown in FIG. 1A, where a high pressure column of fluid flows through a collection conduit against both small particles and gold, beginning the gravitational separation, in accordance with an embodiment of the present invention.
Figure 7:
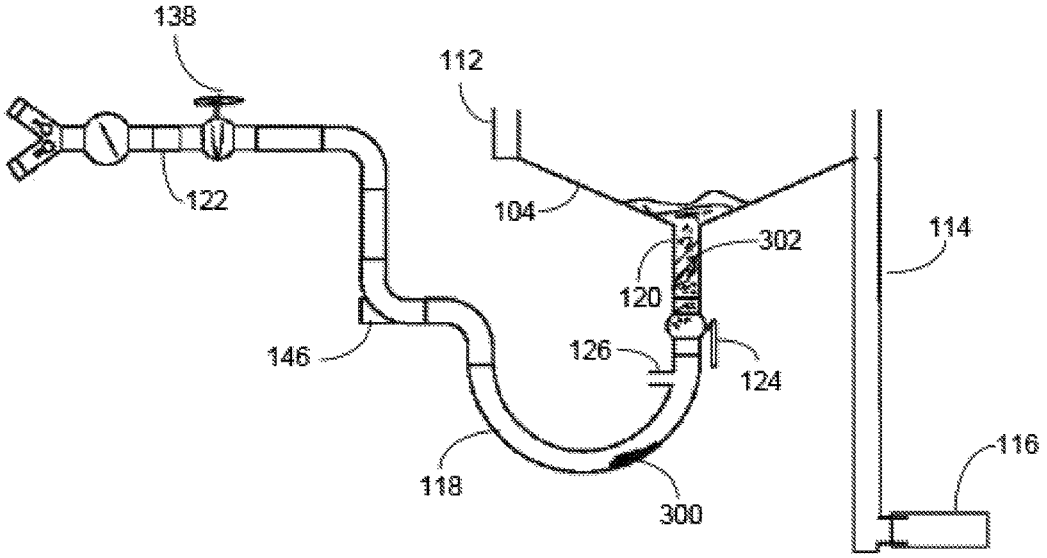
FIG. 7 illustrates a diagram of the assembly shown in FIG. 1A, where the gold is fully separated from the small particles and retained in the collection conduit, in accordance with an embodiment of the present invention.

As FIG. 5 shows, after sieving the aggregate of particles and gold 300, a pressurized column of fluid is forced upwardly, towards the aggregate of small particles 302 and remaining gold 300 that passed through sieves 102*a-f*. The flow velocity may be increased until the aggregate is fluidized and separation of gold 300 from particles begins (FIG. 6). The fluid has sufficient flow velocity to suspend the lighter small particles 302, but insufficient flow velocity to support the more dense gold 300. The gold 300 falls through the pressurized column of fluid through forces of gravity and the specific gravity of the gold 300, relative to the fluid and small particles 302. Thus, the gold 300 falls to a bottom end 108 of the container 104, through the aperture 110, and into a horizontal section of the collection conduit 118, as illustrated in FIG. 7.

Further, the flow velocity of the fluid from fluid source 136 towards container 104 is controllable through flow regulation valve 138. In this manner, the pressure and volume of the fluid may be regulated until substantially only gold 300 falls through aperture 110 at bottom end 108 of container 104, and into collection conduit 118.

Collection conduit 118 may be disposed vertically near the aperture 110, so as to optimize gravitational forces that carry the gold 300 through the collection conduit 118. In one embodiment, collection conduit 118 is disposed in a vertical orientation for about 0.5 meters from the aperture 110 at bottom end 108 of container 104. However as FIG. 1C illustrates, the vertical slope of collection conduit 118 progressively flattens to a horizontal disposition for retention of the separated gold 300. Thus, when gold 300 ceases to fall through aperture 110 at bottom end 108 of container 104 and collect in the horizontal section of collection conduit 118, this indicates that gold 300 is substantially separated from small particles 302 (FIG. 1B).

Figure 8:
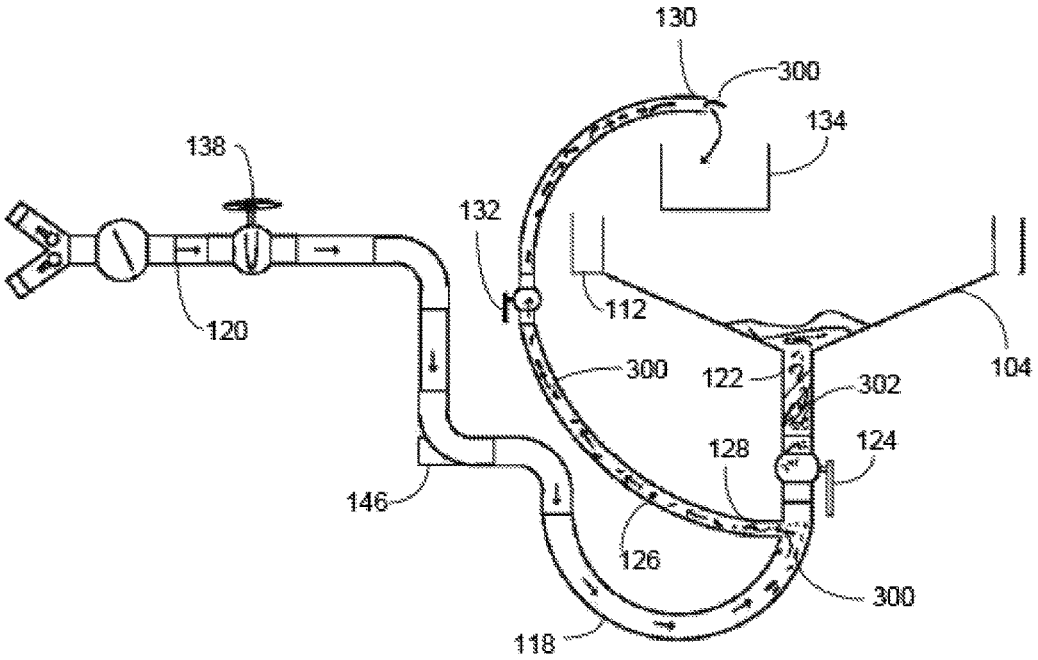
FIG. 8 illustrates a diagram of the assembly shown in FIG. 1A, where the gold is redirected through an extraction conduit for collection, in accordance with an embodiment of the present invention.

At this point of the separation process, container valve 124 at container end 120 of collection conduit 118 is closed to restrict flow of the fluid into container 104 and prevent small particles 302 from falling into collection conduit 118. An extraction conduit 126 is in communication with collection conduit 118. Extraction conduit 126 is configured to carry the gold 300 from collection conduit 118 to a collection bin 134, as illustrated in FIG. 8.

Extraction conduit 126 is defined by a first end 128 and a second end 130. In one embodiment, first end 128 is in communication with container end 120 of collection conduit 118. An extraction valve 132 along extraction conduit 126 may be opened to enable the flow velocity of the fluid to carry the separated gold 300 from collection conduit 118, through extraction conduit 126, and towards the second end 130 of extraction conduit 126. A collection bin 134 is configured to join with second end 130 of the extraction conduit 126 for collection of gold 300.

After gold 300 is collected in collection bin 134, the extraction valve 132 is closed to shut off communication with gold 300 in the collection bin 134. Then, flow regulation valve 138 is closed to shut off the flow of fluid towards container 104. Then, container valve 124 is opened to enable discharge of the small particles 302 from container 104, through aperture 110 in bottom end 108 of container 104, and into the collection conduit 118.

Figure 9:
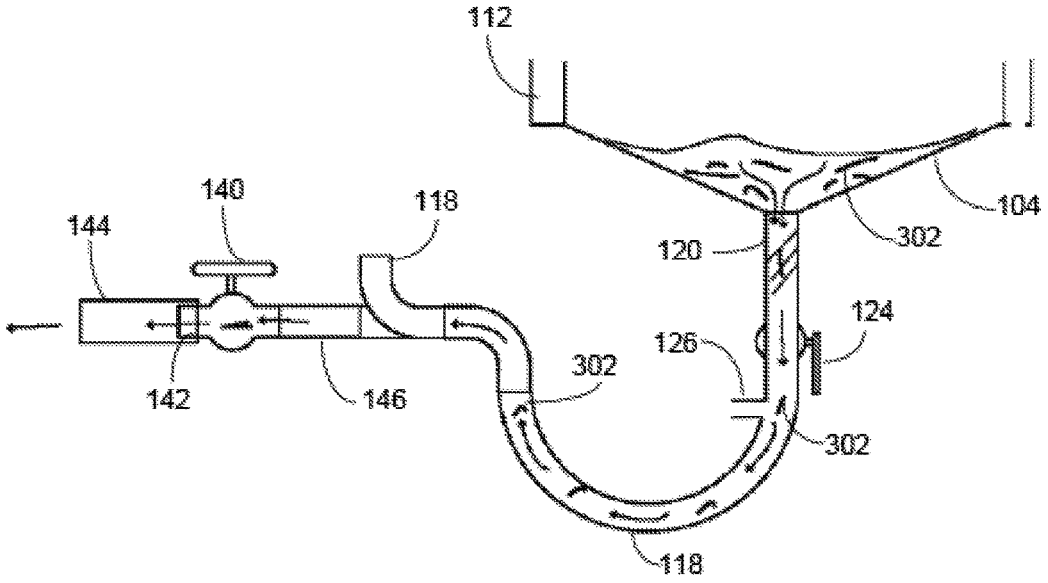
FIG. 9 illustrates a diagram of the assembly shown in FIG. 1A, where the small particles are discharged through a tailings conduit, in accordance with an embodiment of the present invention.

Looking now at FIG. 9, the assembly 100 provides a dump valve 140 to regulate the flow of the fluid and the small particles 302 from collection conduit 118 to a tailings drain 142. Dump valve 140 may be opened so that the remaining small particles 302 in bottom end 108 of container 104 and collection conduit 118 can be carried through a tailings conduit 146 that leads to tailings drain 142. Tailings conduit 146 is in communication with source end 122 of collection conduit 118, and enables discharge of the remaining small particles 302 into tailings drain 142.

It is significant to note that the force of gravity and momentum from excess fluid that has accumulated in the container 104 is the primary force that carries small particles 302 from container 104, through collection conduit 118 and tailings conduit 146, and finally for discharge at tailings drain 142.

In one embodiment, a backflow prevention valve 144 may be operatively connected to tailings drain 142 to restrict undesirable backflow in the collection conduit 118, which may block the free backflow of small particles 302, and also cause contamination of the fluid. The backflow prevention valve 144 is also useful for preventing the loss of any gold 300 if fluid supply pressure is lost. In one embodiment, the backflow prevention valve 144 only operates when a D/C pump is used. When the D/C pump is turned off the liquid, particles, and any material flow back into the D/C pump.

In another embodiment, container 104 may include a trough 112 for retaining excess fluid that accumulates. Trough 112 may encircle periphery of container 104, so as to capture all excess fluid flowing therein. It is significant to note that when the assembly 100 is operating, excess fluid becomes problematic. Trough 112 helps capture and redirect excess fluid away from assembly 100. A container conduit 114 leading from trough 112 carries the excess fluid out. Container conduit 114 may join with a fluid drain 116 that discharges the excess fluid.

Figure 10:
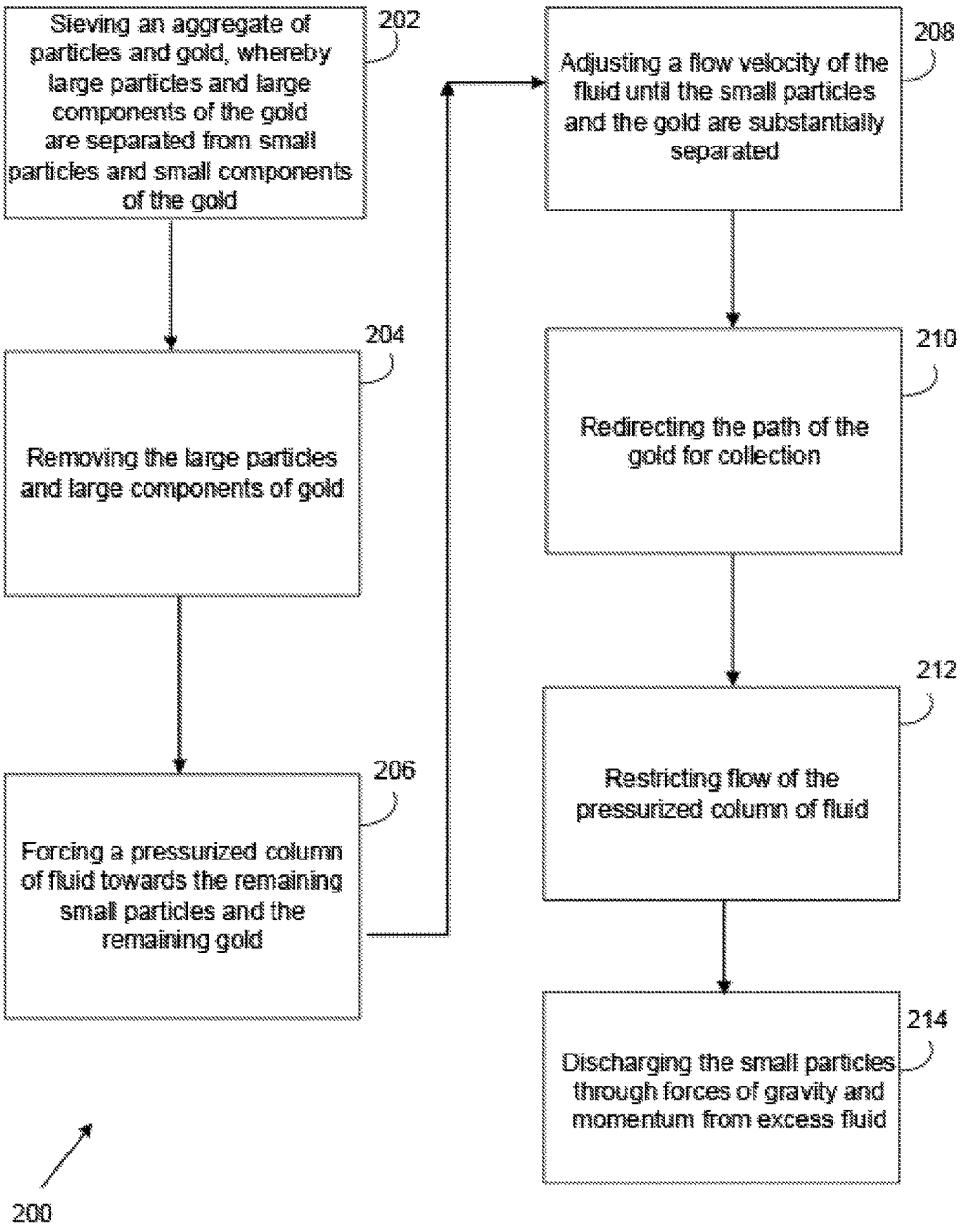
FIG. 10 illustrates a rear perspective of the method for gravitationally separating gold from small particles, in accordance with an embodiment of the present invention.

FIG. 10 illustrates a flowchart diagram of an exemplary method 200 for separating gold 300 from small particles 302. Method 200 comprises an initial Step 202 of sieving an aggregate of particles and gold 300, whereby large particles and large components of the gold 300 are separated from small particles 302 and small components of the gold 300. In some embodiments, Step 202 of sieving an aggregate of particles 304 and gold 300, further comprises washing aggregate 304 containing particles and gold.

In other embodiments, Step 202 of sieving an aggregate 304 of particles and gold is operable with a series of sieves 102*a-f* having graduated mesh sizes (FIGS. 3 and 4). Sieves are primarily utilizes to remove the large particles and the larger components of gold. Sieves 102*a-f* includes at least one member selected from the group consisting of: a ½ inch mesh, a ¼ inch mesh, a ⅛ inch mesh, a 1/16 inch mesh, a 1/32 inch mesh, and a 1/64 inch mesh.

In some embodiments, a Step 204 may include removing the large particles and large components of gold 300. The large particles and larger components of gold 300 may be approximately larger than 1 millimeter in diameter. In some embodiments, the remaining gold 300 after removal of the large particles and large components of gold is smaller than about 1 millimeter. The remaining small particles 302 may include sand particles, small pebbles, and mineral fragments—all having passed through sieves 102*a-f*, and about less than 1 millimeter in diameter.

A Step 206 may include forcing a pressurized column of fluid towards the remaining small particles 302 and the remaining gold 300 (FIG. 6). After the sieving process removes the large particles, the gravitational separation process begins through use of the pressurized column of fluid. In some embodiments, Step 206 of forcing a pressurized column of fluid towards the remaining small particles 302 and the remaining gold 300, further comprises opening a flow regulation valve 138 to regulate the volume and pressure of the pressurized column of fluid.

A Step 208 includes adjusting a flow velocity of the fluid until the small particles 302 and the gold 300 are substantially separated, whereby the small particles 302 are suspended by the flow velocity of the fluid, whereby the gold 300 falls against the flow velocity of the fluid through forces of gravity and the specific gravity of the gold 300 relative to the fluid and small particles 302 (FIG. 7). Here the flow regulation valve 138 may be operated. Visual inspection of the gravitational separation allows for precise adjustments. Gold 300 eventually rests in a horizontal section of the collection conduit 118.

Another Step 210 includes redirecting the path of the gold 300 for collection (FIG. 8). In some embodiments, Step 210 of redirecting the path of the gold 300 for collection, further comprises closing a container valve 124 and opening an extraction valve 132. Step 210 may also include collecting the gold 300 in a collection bin 134. A Step 212 may include restricting flow of the pressurized column of fluid. In some embodiments, Step 212 comprises closing the flow regulation valve 138 to enable the excess fluid in the container and gravity to carry the small particles 302 for discharge. Step 212 may also include closing an extraction valve 132 that regulates access to extraction conduit 126.

A final Step 214 comprises discharging the small particles 302 through forces of gravity and momentum from excess fluid (FIG. 9). The Step 214 may require opening a dump valve 140 to enable carrying the small particles 302 through a tailings conduit 146, which leads to a tailings drain 142. A backflow prevention valve 144 may be used to prevent undesirable backflow through tailings conduit 142 and collection conduit 118.

These and other advantages of the invention will be further understood and appreciated by those skilled in the art by reference to the following written specification, claims and appended drawings.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What I claim is:

1. A method for separating gold from small particles, the method comprising:

sieving an aggregate of particles and gold, whereby large particles and large components of the gold are separated from small particles and small components of the gold;

removing the large particles and large components of gold;

forcing a pressurized column of fluid through a collection conduit having a downward curve, the collection conduit defined by a source end and a container end, wherein the source end and the container end are vertically above a lower curved portion of the collection conduit;

the container end configured to join with an aperture of the container, wherein the pressurized column of fluid first flows in a direction with a force of gravity, and second flows in a direction opposite the force of gravity and towards the remaining small particles and the remaining gold;

setting a flow velocity of the fluid whereby the flow velocity of the fluid imparts a force approximately equivalent to the force of gravity on the small particles and the gold so that the small particles and the gold are continuously suspended by the flow velocity of the fluid, adjusting the flow velocity of the fluid and inspecting visually through the collection conduit for gravitational separation until the gold falls against the flow velocity of the fluid based upon the density of the gold relative to flow velocity of the fluid and density of the small particles until the small particles and the gold are isolated from each other;

redirecting the path of the gold for collection through an extraction conduit by opening an extraction valve in the extraction conduit, wherein the extraction conduit is in fluid communication with the container end of the collection conduit and has an opening into the container end of the collection conduit below the container valve; and discharging the small particles through forces of gravity and momentum from excess fluid.

2. The method of claim 1, wherein the step of sieving an aggregate of particles and gold, further comprises washing the aggregate of particles and gold.

3. The method of claim 1, wherein the step of sieving an aggregate of particles and gold is operable with a series of sieves having graduated mesh sizes.

4. The method of claim 3, wherein the series of sieves includes at least one member selected from the group consisting of: a ½ inch mesh, a ¼ inch mesh, a ⅛ inch mesh, a 1/16 inch mesh, a 1/32 inch mesh, and a 1/64 inch mesh.

5. The method of claim 1, wherein the step of forcing a pressurized column of fluid towards the remaining small particles and the remaining gold, further comprises at least partially opening a flow regulation valve.

6. The method of claim 5, wherein the step of restricting flow of the pressurized column of fluid, further comprises at least partially closing the flow regulation valve.

7. The method of claim 1, wherein the step of adjusting a flow velocity of the fluid until the small particles and the gold are substantially separated, further comprises retaining the gold in a collection conduit.

8. The method of claim 1, further comprising a step of stabilizing the flow of fluid with a pressure regulator.

9. The method of claim 1, wherein the step of redirecting the path of the gold for collection, further comprises closing a container valve and opening an extraction valve.

10. The method of claim 1, further comprising a step of inhibiting backflow of the fluid with a backflow prevention valve.

11. The method of claim 1, wherein the step of discharging the small particles through forces of gravity and momentum from excess fluid, further comprises opening a dump valve to enable carrying the small particles through a tailings conduit to a tailings drain.

12. The method claim 11, further comprising a step of shutting off the tailings drain.

13. A method for separating gold from small particles, the method comprising:

sieving an aggregate of particles and gold, whereby large particles and large components of the gold are separated from small particles and small components of the gold;

washing the aggregate of particles and gold;

removing the large particles and large components of gold;

forcing a pressurized column of fluid through a collection conduit having a downward curve, the collection conduit defined by a source end and a container end, the container end configured to join with an aperture of the container, wherein the pressurized column of fluid first flows in a direction with a force of gravity, and second flows in a direction opposite a force of gravity and towards the remaining small particles and the remaining gold;

setting a flow velocity of the fluid whereby the flow velocity of the fluid imparts a force approximately equivalent to the force of gravity on the small particles and the gold so that the small particles and the gold are continuously suspended by the flow velocity of the fluid, adjusting the flow velocity of the fluid and inspecting visually through the collection conduit for gravitational separation until the gold falls against the flow velocity of the fluid based upon the density of the gold relative to flow velocity of the fluid and density of the small particles until the small particles and the gold are isolated from each other;

separating the gold from the small particles by closing a container valve, wherein the container valve is located above the suspended gold in the collection conduit, and below the small particles, in a vertical portion of the container end of the collection conduit;

redirecting the path of the gold for collection through an extraction conduit by opening an extraction valve in the extraction conduit, wherein the extraction conduit is in fluid communication with the container end of the collection conduit and has an opening into the container end of the collection conduit below the container valve;

restricting flow of the pressurized column of fluid; and discharging the small particles through forces of gravity and momentum from excess fluid.

14. The method of claim 13, wherein the step of sieving an aggregate of particles and gold is operable with a series of sieves having graduated mesh sizes.

15. The method of claim 14, wherein the series of sieves includes at least one member selected from the group consisting of: a ½ inch mesh, a ¼ inch mesh, a ⅛ inch mesh, a 1/16 inch mesh, a 1/32 inch mesh, and a 1/64 inch mesh.

16. The method of claim 13, wherein the step of forcing a pressurized column of fluid towards the remaining small particles and the remaining gold, further comprises at least partially opening a flow regulation valve.

17. The method of claim 16, wherein the step of restricting flow of the pressurized column of fluid, further comprises at least partially closing the flow regulation valve.

18. The method of claim 13, wherein the step of adjusting a flow velocity of the fluid until the small particles and the gold are substantially separated, further comprises retaining the gold in a collection conduit.

19. The method of claim 13, further comprising a step of stabilizing the flow of fluid with a pressure regulator.

20. A method for separating gold from small particles, the method consisting of:

sieving an aggregate of particles and gold through a series of sieves having graduated mesh sizes, whereby large particles and large components of the gold are separated from small particles and small components of the gold;

washing the aggregate of particles and gold;

removing the large particles and large components of gold;

forcing a pressurized column of fluid through a collection conduit having a downward curve, the collection conduit defined by a source end and a container end, the container end configured to join with an aperture of the container, wherein the pressurized column of fluid first flows in a direction with a force of gravity, and second flows in a direction opposite a force of gravity and towards the remaining small particles and the remaining gold;

at least partially opening a flow regulator valve;

setting a flow velocity of the fluid whereby the flow velocity of the fluid imparts a force approximately equivalent to the force of gravity on the small particles and the gold so that the small particles and the gold are continuously suspended by the flow velocity of the fluid, adjusting the flow velocity of the fluid and inspecting visually through the collection conduit for gravitational separation until the gold falls against the flow velocity of the fluid;

based upon the density of the gold relative to flow velocity of the fluid and density of the small particles until the small particles and the gold are isolated from each other;

separating the gold from the small particles by closing a container valve, wherein the container valve is located above the suspended gold, and below the small particles, in a vertical portion of the container end of the collection conduit;

stabilizing the flow of fluid with a pressure regulator;

redirecting the path of the gold for collection through an extraction conduit by opening an extraction valve in the extraction conduit, wherein the extraction conduit is in fluid communication with the container end of the collection conduit and has an opening into the container end of the collection conduit below the container valve;

at least partially closing the flow regulation valve;

restricting the flow of the pressurized column of fluid;

discharging the small particles through forces of gravity and momentum from excess fluid;

opening a dump valve to enable carrying the small particles through a tailings conduit to a tailings drain;

shutting off the tailing drain; and inhibiting backflow of the fluid with a backflow prevention valve.

* * * * *